US009328472B2

(12) United States Patent
Barrett et al.

(10) Patent No.: US 9,328,472 B2
(45) Date of Patent: May 3, 2016

(54) SYSTEM AND METHOD FOR DETERMINING OPTIMAL DESIGN CONDITIONS FOR STRUCTURES INCORPORATING GEOSYNTHETICALLY CONFINED SOILS

(71) Applicant: R&B LEASING, LLC, Grand Junction, CO (US)

(72) Inventors: Robert K. Barrett, Boca Grande, FL (US); Albert C. Ruckman, Palisade, CO (US); Colby Barrett, Grand Junction, CO (US)

(73) Assignee: R&B LEASING, LLC, Grand Junction, CO (US)

( * ) Notice: Subject to any disclaimer, the term of this patent is extended or adjusted under 35 U.S.C. 154(b) by 207 days.

(21) Appl. No.: 13/961,602

(22) Filed: Aug. 7, 2013

(65) Prior Publication Data

US 2015/0040649 A1 Feb. 12, 2015

(51) Int. Cl.
*E02D 1/08* (2006.01)

(52) U.S. Cl.
CPC ..... *E02D 1/08* (2013.01)

(58) Field of Classification Search
CPC ..... E02D 7/02; E02D 7/06; E02D 7/18; E02D 7/26; E02D 7/28; E02D 7/30; E02D 13/04; E02D 27/00; E02D 3/068; E02D 33/00; E02D 27/14; E02D 1/022
USPC ..... 73/84
See application file for complete search history.

(56) References Cited

U.S. PATENT DOCUMENTS 3,710,578 A * 1/1973 Inoue ..... E02D 17/04 405/282
3,909,148 A * 9/1975 Vural ..... E02D 3/046 404/133.05
3,923,412 A * 12/1975 Linz ..... E02D 3/068 404/133.05
4,127,351 A * 11/1978 Vural ..... E02D 3/02 404/133.05
4,382,715 A * 5/1983 Vural ..... E02D 3/046 404/117

(Continued)

OTHER PUBLICATIONS

"Geosynthetic Reinforced Soil Integrated Bridge System Interim Implementation Guide," U.S. Department of Transportation Federal highway Administration, Jun. 2012, 176 pages.

(Continued)

*Primary Examiner* — Freddie Kirkland, III
(74) *Attorney, Agent, or Firm* — Sheridan Ross PC

(57) ABSTRACT

A system and method are provided for determining optimal design conditions for structures incorporating geosynthetically confined soils. A testing apparatus referred to as a load frame simulates a particular geostructural construction without having to construct a full-scale or near full-scale model. The load frame includes an enclosure made from materials such as concrete block or rigid panels that enclose a plurality of layers of geosynthetic materials and lifts of representative soil and aggregate obtained from the jobsite of the geostructural construction. An upper load plate and lower load plate confine the lifts and geosynthetic materials. A load is applied to the upper load plate in order to compact the contents within the load frame. Both static and vibratory energy can be applied for the loading, thereby closely replicating actual compaction efforts at the job site. Once the contents have been compacted, compaction testing can be conducted to confirm design parameters.

30 Claims, 7 Drawing Sheets

(56) References Cited

U.S. PATENT DOCUMENTS

| | | | | |
|---|---|---|---|---|
| 4,722,635 | A * | 2/1988 | Schnell | E02D 3/046 404/102 |
| 6,171,984 | B1 | 1/2001 | Paulson et al. | |
| 6,213,681 | B1 * | 4/2001 | Sick | E01C 19/38 366/116 |
| 6,604,432 | B1 * | 8/2003 | Hamblen | E02D 1/02 73/594 |
| 6,808,339 | B2 | 10/2004 | Peterson et al. | |
| 6,874,974 | B2 * | 4/2005 | VanBuskirk | E02D 29/05 405/124 |
| 6,890,127 | B1 | 5/2005 | Barrett et al. | |
| 7,110,884 | B2 * | 9/2006 | Tritico | E02D 3/02 702/2 |
| 7,191,664 | B2 * | 3/2007 | Thom | G01N 3/08 73/805 |
| 7,384,217 | B1 | 6/2008 | Barrett et al. | |
| 8,215,869 | B2 | 7/2012 | Vanbuskirk | |
| 8,696,248 | B2 * | 4/2014 | Lynderup | E02B 17/02 405/227 |
| 8,898,996 | B2 * | 12/2014 | Garzon | E02D 29/02 405/271 |
| 2005/0019105 | A1 * | 1/2005 | Tritico | E02D 3/02 405/271 |
| 2005/0191758 | A1 * | 9/2005 | Pether | G01N 3/10 436/174 |
| 2013/0243532 | A1 * | 9/2013 | Lynderup | E02B 17/02 405/232 |
| 2014/0215959 | A1 * | 8/2014 | Garzon | E02D 29/02 52/741.11 |

OTHER PUBLICATIONS

Taylor "AASHTO T 99 and T180—Moisture-Density Relations of Soils," North Dakota Department of Transportation, revised Jun. 17, 2011, 9 pages.

* cited by examiner

SYSTEM AND METHOD FOR DETERMINING OPTIMAL DESIGN CONDITIONS FOR STRUCTURES INCORPORATING GEOSYNTHETICALLY CONFINED SOILS

FIELD OF THE INVENTION

The invention relates to testing of geostructural constructions incorporating geosynthetic materials such as geotextiles and geogrids placed between lifts of compacted earth, and more particularly, to a system/device and method for testing geostructural constructions, including a load frame device that simulates a full scale construction using geosynthetic materials.

BACKGROUND OF THE INVENTION

Geosynthetic material is used in a number of earthen supported constructions. Geosynthetic material generally refers to synthetic engineered products used in civil engineering projects including soil stabilization structures, corrosion barriers, retaining walls, abutments, and other earthworks requiring reinforcement. It has been found that geosynthetic material can offer a cost-effective and structurally sound alternative to many traditional concrete and block construction methods.

General types of geosynthetic materials include geotextiles or geotextile fabrics, geogrids, geomembranes, geosynthetic liners, geosynthetic erosion control products, and other specially designed geosynthetics. There are number of applications where geosynthetic materials may be employed, and the use of geosynthetic material applications is not limited to any particular field within civil engineering construction. Some of the more common functions that can be achieved with the use of geosynthetic material include erosion control, moisture control, drainage control, soil filtration and separation, soil reinforcement, and soil stabilization. One particular advantage provided by geosynthetic materials is that the materials provide substantial benefits in increasing both the tensile and shear strength of earthen supported structures. While concrete and block constructions may provide significant compressive strength, it is well known that these constructions can be woefully inadequate in terms of tensile and shear strength requirements.

Geosynthetic materials are commonly made from polymeric formulations, and another advantage of geosynthetic materials is that formulations can be adapted to achieve required strength specifications, and to otherwise be formulated for specific uses. With the wide range of polymeric materials available, geosynthetic uses continue to increase across many different types of construction applications.

One example of a reference that discloses a fiber-based geosynthetic material includes the U.S. Pat. No. 6,171,984. The reference also generally discloses geosynthetic composites with combinations of geosynthetic material including geotextiles fabrics and geomembranes.

U.S. Pat. No. 8,215,869 discloses a reinforced soil arch including alternating and interacting layers of compacted mineral soil and geosynthetic reinforcement material placed over and adjacent to the archway.

U.S. Pat. No. 6,890,127 discloses subsurface supports that may be used to support bridges and culverts, and more particularly, subsurface supports in the form of platforms that prevent scour type erosion that may develop from a body of moving water, such as a river or stream. The construction of the platforms includes the use of stabilizing sheet material, such as wire mesh, geosynthetic sheets, or combinations thereof.

U.S. Pat. No. 7,384,217 discloses a system and method for promoting vegetation growth on a steeply sloping surface. The system includes anchors secured to the sloping surface, an inner mesh layer in contact with the slope, a geosynthetic layer placed over the inner mesh layer, and seeded compost material placed in a gap or space between the geosynthetic layer and the inner mesh layer. And outer mesh layer is placed over the geosynthetic layer to stabilize the geosynthetic layer. Vegetation grows in the compost material, and roots of the vegetation penetrate the inner mesh layer into the slope for long term stabilization of the sloping surface to prevent erosion.

U.S. Pat. No. 6,808,339 discloses a modular retaining wall having tiers of headers which extend into compacted backfill material, and tiers of stretchers that extend between headers to form a front face of the wall. Layers of geosynthetic mesh reinforcement reinforce the load bearing capability of the backfill. Load forces in the backfill are sustained by forward ends of the layers of geosynthetic mesh reinforcement that extend upward in front of the backfill and then backward into the backfill instead of being sustained by the stretchers.

It is apparent from the wide variation in use of geosynthetic material disclosed in these references that geosynthetics can be used in multiple different types of constructions. Despite the increasing expansion in the use of geosynthetic material, there are still limitations in use of these materials. In the case of using geosynthetic material for larger scale construction projects, there is still a need to conduct on-site testing to confirm that the geosynthetic material in combination with the compacted earth formations achieve the necessary strength requirements for the particular project. Unlike concrete that may be tested in predictable and accurate small scale testing, such as slump testing, there is yet to be developed a uniform set of standards for determining how to employ geotextiles materials across various loading conditions.

Some efforts have been made to provide uniform guidance regarding employment of geotextile material. One example is the Geosynthetic Reinforced Soil Integrated Bridge System Interim Implementation Guide, published by the US Department of Transportation, Federal Highway Administration (June 2012). This reference generally discloses construction examples and preferred specifications for different types of constructions. This reference also discloses quality control and quality assurance measures, to include field testing and laboratory testing, and some guidance regarding stability analyses that may be conducted to confirm design specifications. However, this reference fails to disclose a testing method or procedure that can be used across many different types of construction projects to confirm actual performance of geosynthetically confined soils.

Because of the inherent number of variables with respect to use of geosynthetically confined soils, it has been difficult to develop a reliable and defensible mathematical equation that represents or predicts the behavior of soil and geosynthetic materials used in various constructions. For example, it is well known that the optimal compaction for soil greatly varies depending upon the type of soils encountered at a particular job site and therefore, designing and confirming a successful design using geosynthetics often requires trial and error testing at the jobsite in which soil and aggregate compaction is continually measured, and each lift of soil/aggregate must be tested multiple times to confirm optimal compaction. Further, the spacing of geotextile layers and a determination as to the number of layers used in a particular cross-section is not an established design sequence. Therefore, intense quality control is required at jobsite to ensure each lift of soil/aggregate material is properly compacted. Further, efforts have to be made to ensure that the soil/aggregate used at the jobsite is tested for optimal moisture content to ensure the type of soil and aggregate present can achieve its maximum dry density while the project is being constructed. Proctor compaction testing is yet another aspect of the construction process that can result with introduction of further variables for complicating design and implementation of a particular geostructural construction.

Therefore, it is apparent that a testing protocol or testing method is needed to enhance predictability of geostructural constructions, to not only reduce the potential for non-complying constructions, but also to reduce overall jobsite effort required for testing and quality control. There is also a need to provide a testing protocol and/or method that is easily transportable, and that can be quickly and efficiently conducted. There is yet a further need for a testing protocol/method in which deficiencies encountered regarding tested parameters can be retested and verified, thus preventing project delays and additional costs.

SUMMARY OF THE INVENTION

According to the present invention, a system and method are provided for determining optimal design conditions for structures incorporating geosynthetically confined soils. In one aspect of the invention, it includes a testing apparatus or assembly that simulates a particular geostructural construction without having to construct a full-scale or near full-scale model. The testing apparatus or assembly can be referred to as a demonstration load frame that replicates a portion or section of the geostructural construction. The load frame includes an enclosure made from materials such as concrete block or rigid panels that enclose a plurality of layers of geosynthetic materials and lifts of representative soil and aggregate from the jobsite for the geostructural construction site at issue. The size of the load frame is such that the layers of geosynthetic material and soil/aggregate are not overly confined or limited by walls of the enclosure, which might otherwise serve to falsely compact the layers as compared to the actual construction design in which lateral containment may not be present. In this respect, the load frame can be constructed with walls of the enclosure forming a square or rectangular shape, with a minimum distance between opposing walls of the enclosure preferably greater than approximately three feet which enables soil/aggregate to more naturally compact as compared to a smaller testing cylinder that may overly constrain the soil/aggregate and geosynthetic material.

In order to adequately simulate compaction efforts at a jobsite, the method of the present invention has the capability to provide not only compressive forces to optimally compact the strata or layers of soil/aggregate and geosynthetic material, but also vibratory energy to provide a preferred method for compaction to achieve optimal simulation of compaction employed in a construction project. As used hereinafter, the term "fill" is intended to mean the combination of soil and aggregate used to simulate the soil and aggregate for the jobsite of the actual construction project for which testing is conducted. Preferably, the fill used in the load frame is the same as the soil/aggregate to be used in the project. In one preferred embodiment of the load frame, it is constructed in successive layers in which a layer of geosynthetic material and a corresponding layer or lift of fill is laid down within an enclosure of concrete blocks or rigid panels. The fill is compacted, and then another layer of geosynthetic material and another lift of fill is added and compacted within the enclosure. One row of blocks can be added for each layer of geosynthetic material and lift of fill so that the peripheral edges of the geosynthetic material can be held between the rows of blocks. An adequate number of layers of geosynthetic material and lifts of fill are constructed to simulate the particular construction project.

Compaction of the layers of fill in the load frame can be completed in different methods to best simulate optimal compaction specifications for the project. According to one method of compaction of the invention as mentioned, the fill can be compacted within the load frame upon construction of each successive layer of geosynthetic material and corresponding lift of fill. According to another method of compaction, compaction can be conducted after the load frame has been constructed with multiple layers of geosynthetic material and fill resulting in a compaction effort conducted to simultaneously compact multiple layers.

The type of energy supplied to the load frame in order to achieve compaction includes static compaction forces and vibratory compaction forces. In one embodiment, compaction is achieved by use of hydraulic jacks that apply force to connected upper and lower load plates. The controlled and gradual application of compressive force is used to compact the layers of geosynthetic material and corresponding lifts of fill. In addition to this static application of force, a mechanical vibrator can be used in conjunction with the hydraulic jacks in order to vibrate contents within the load frame. One advantage of also providing vibratory compaction is that it more closely simulates actual compaction efforts at the jobsite. As an alternative to use of hydraulic jacks, static compression force can be supplied by other means, such as by an inflatable airbag.

According to another embodiment of the load frame, instead of using stacked rows of blocks, the load frame may be constructed with removable panels. According to one method of construction of the load frame with removable panels, three sides of a four sided load frame can be assembled with one side remaining open to allow placement of layers of geosynthetic material and fill. Having one open side eases compaction efforts if the method of compaction employs a separate compaction steps for each layer/lift since the open side provides easier access to the layers of fill. The fourth side of the load frame can be installed, and final compaction can then be completed with compressive and/or vibratory force applied to the upper and lower load plates.

Once compaction is completed, the walls of the load frame may be removed in order to inspect the layers of geosynthetic material and corresponding lifts. Compaction and density testing can then be conducted, or other test protocols can be conducted in order to confirm design specifications for the project. Having the capability to view the geosynthetic material and lifts of fill in cross-section also provides an excellent manner in which to inspect the compaction results, and to modify design parameters as necessary.

In another aspect of the method of the present invention, additional compaction could be performed after the walls of the load frame are removed in order to further stimulate loading conditions, and to confirm design parameters. For example, if a project had specific loading conditions that needed to be replicated, such as continual impact loading conditions, additional compaction efforts could be conducted with the walls of the load frame removed in order to further study the performance of the simulated construction achieved with the geosynthetic layers and lifts of fill.

Considering the above aspects and features of the invention, it can be considered a device for testing design specifications for a construction project incorporating geosynthetically confined soils, comprising: (i) a load frame having a plurality of walls; (ii) a plurality of layers of geosynthetic material placed within an open space between said plurality of walls; (iii) a plurality of layers of fill material located between said plurality of layers of geosynthetic material; (iv) an upper load plate covering the open space; (v) at least one force applying member communicating with said upper load plate for applying a force to compact the fill material; and wherein force is applied by said force applying member to compact the fill material.

In another aspect of the invention, it can be considered a device for testing design specifications for a construction project incorporating geosynthetically confined soils comprising: (i) a load frame having a plurality of walls; (ii) a plurality of layers of geosynthetic material placed within an open space between said plurality of walls; (iii) a plurality of layers of fill material located between said plurality of layers of geosynthetic material; (iv) an upper load plate covering the open space; (v) at least one force applying member communicating with said upper load plate for applying a force to compact the fill material; (vi) a lower load plate placed beneath a most lower layer of said plurality of layers of fill material; (vii) at least one retention bar interconnecting said upper load plate and said lower load plate; and wherein force is applied by said force applying member to compact the fill material, and said upper and lower load plates secure said layers of fill material and geosynthetic materials enabling the force applied to compact the fill material.

In yet another aspect of the invention, it can be considered a method to test design specifications for constructions incorporating geosynthetically confined soils, comprising: (i) constructing a load frame having a plurality of walls to enclose a quantity of fill material and geosynthetic material; (ii) installing at least one layer of geosynthetic material within an open space between said plurality of walls; (iii) loading at least one layer of fill material within the open space between said plurality of walls and in contact with said layer of geosynthetic material (iv) covering the layer of geosynthetic material and layer of fill material; (v) applying force to compact said layer of fill material; and (vi) conducting a compaction test to determine whether the layer of fill material is compacted to design specifications for the project.

Other features and advantages of the invention will become apparent from review the following detailed description, taken in conjunction with the drawings.

DETAILED DESCRIPTION

Figure 1:
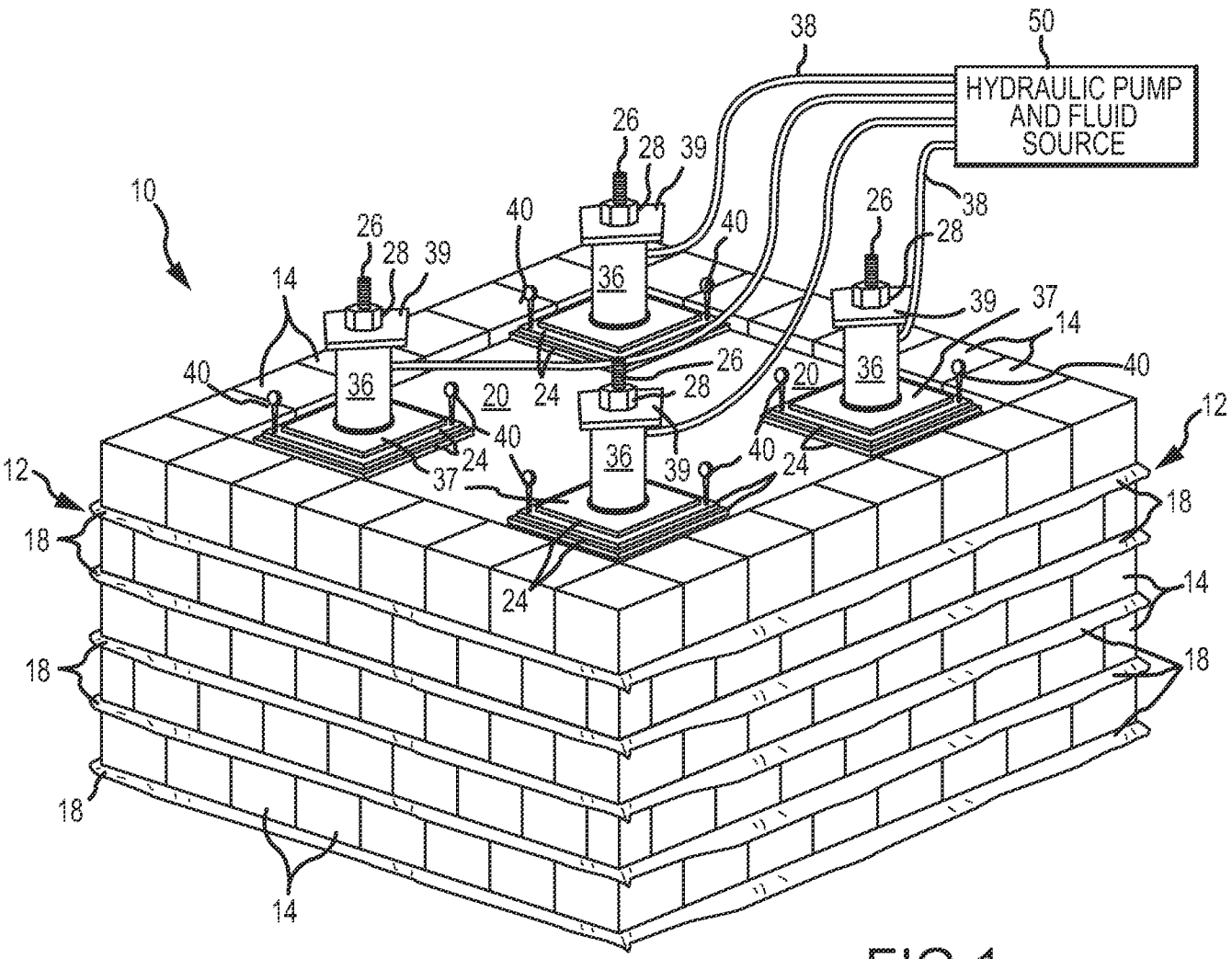
FIG. 1 is a perspective view of a load frame according to a first embodiment of the system and method of the invention.
Figure 2A:
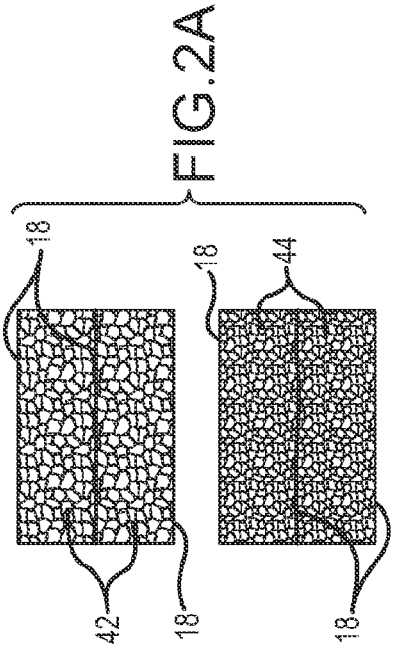
FIG. 2A provides two enlarged partial cross-sectional views of portions of FIG. 2, namely, one view showing non-compacted fill and the other showing compacted fill.
Figure 2:
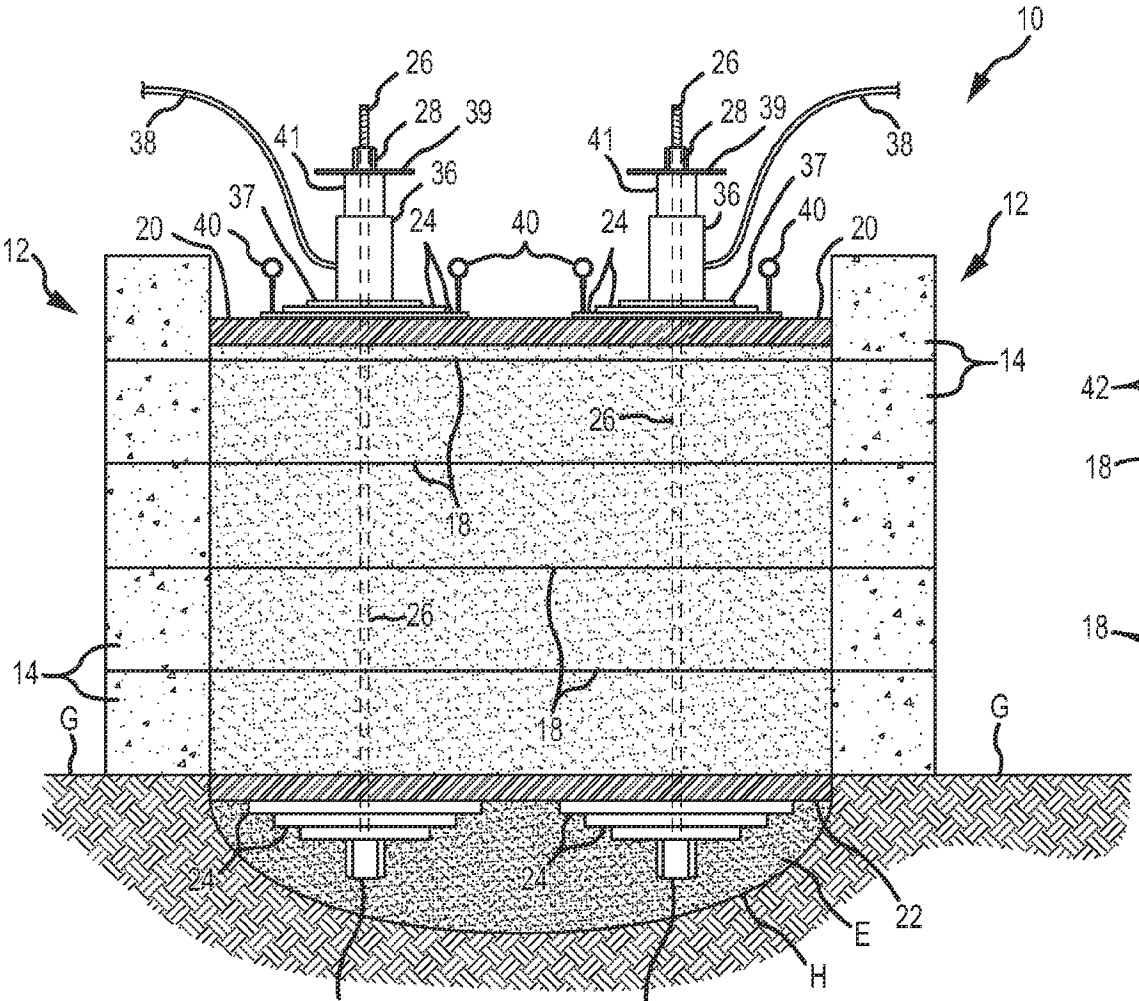
FIG. 2 is a cross-sectional view of the load frame of FIG. 1.

Referring to FIGS. 1 and 2, a load frame device 10 is illustrated in a first embodiment. The purpose of the device is to provide simulation for layers of geosynthetic material and fill, such as used within a geostructural construction, so that testing can be conducted to validate design specifications. The testing conducted may include compaction testing or other industry specific testing associated with geostructural projects. The device 10 has frame walls 12 that enclose a quantity of fill and vertically spaced layers of geosynthetic material, such as geosynthetic layers or sheets 18. As shown, the device 10 may be a square or rectangular shaped enclosure with the frame walls 12 made from stacked blocks or bricks 14. Successive layers or sheets of the geosynthetic material 18 extend substantially horizontally across the interior of the device, and peripheral edges of the geosynthetic material 18 are trapped between rows of the blocks 14. As shown, the peripheral edges of the geosynthetic material may extend beyond the exterior surfaces of the walls 12. Fill material 16 is placed between the layers of geosynthetic sheets 18.

Referring specifically to FIG. 2, a compressive load may be applied to the geosynthetic layers and fill by use of a pair of opposing compression load plates that trap the geosynthetic layers and fill. As shown, an upper load plate 20 is placed over the most upper layer of fill 16, and a lower load plate 22 is placed beneath and supports the most lower layer of fill 16. A loading apparatus is used to supply compressive force to compact the layers of fill, and the first embodiment employs a plurality of jacks 36 as shown. Each of the jacks 36 are mounted over one or more upper force distributing plates 24. Specifically, each of the jacks 36 are illustrated as having a base 37 that is aligned and mounted over two stacked force distributing plates 24. Threaded retention bars 26 extend through the jacks 36, through the upper load plate 20, through the layers of geosynthetic material and fill, and finally through the lower load plate 22 thereby interconnecting the upper and lower load plates.

Lower force distributing plates 24 are mounted over the respective lower ends of the retention bars 26, and the retention bars are locked in place against the lower surface of the lower load plate 22 by respective lower securing nuts 28. As shown in FIG. 2, a hole H may be dug in the ground G to accommodate space for the lower load plate 22, lower force distributing plates 24 and lower nuts 28. This hole allows the first row of blocks 14 to rest on the ground. The hole H may be filled with earth E as needed to help stabilize the lower load plate 22 and the lower force distributing plates 24.

The upper ends of the retention bars 26 extending through the jacks 36 and are locked in place by respective upper securing nuts 28 threaded over the upper ends and tightened against the jacks 36 as shown. Each of the jacks 36 includes a moveable cylinder 41 that is selectively raised or lowered by hydraulic fluid, and the upper edge of each of the cylinders 41 contacts a blocking bushing or washer 39 that is locked in place by the corresponding upper securing nut 28.

Hydraulic lines 38 provide fluid to the hydraulic jacks 36 by a hydraulic fluid source and hydraulic pump, shown schematically as a combined element 50. The pump is activated to force fluid through the lines 38 and into the jacks 36, resulting in a compressive force applied to the interior of the load frame by downward displacement of the upper load plate 20. FIG. 1 illustrates the jacks 36 prior to activation in which the moveable cylinders 41 of the jacks are fully retracted within the casings or bodies of the jacks 36. Referring to FIG. 2, as the hydraulic jacks 36 are activated, the cylinders 41 project incrementally upward causing the upper load plate 20 to be forced downward into the interior of the device 10. An operator may manually tighten or loosen the upper nuts 28 against the blocking bushings 39 to adjust the distance between the upper and lower compression plates, it being understood that the limit of downward travel of the upper load plate 20 is defined by the maximum extended length of the cylinders 41 when activated. Continued operation of the jacks 36 results in progressive lowering of the plate 20 within the load frame until the cylinders 41 are fully extended.

FIG. 2A is provided to illustrate a compaction effort in which loose granular fill material 42 has yet to be compacted within the load frame, and the results achieved after compaction in which the fill material becomes compacted fill 44. More specifically, the upper cross section shows the loose granular fill material 42 with non-compacted granules and air voids between the granules. The lower cross section shows the same cross-section after compaction in which the granules are compacted, and the air voids are significantly reduced.

Figure 3:
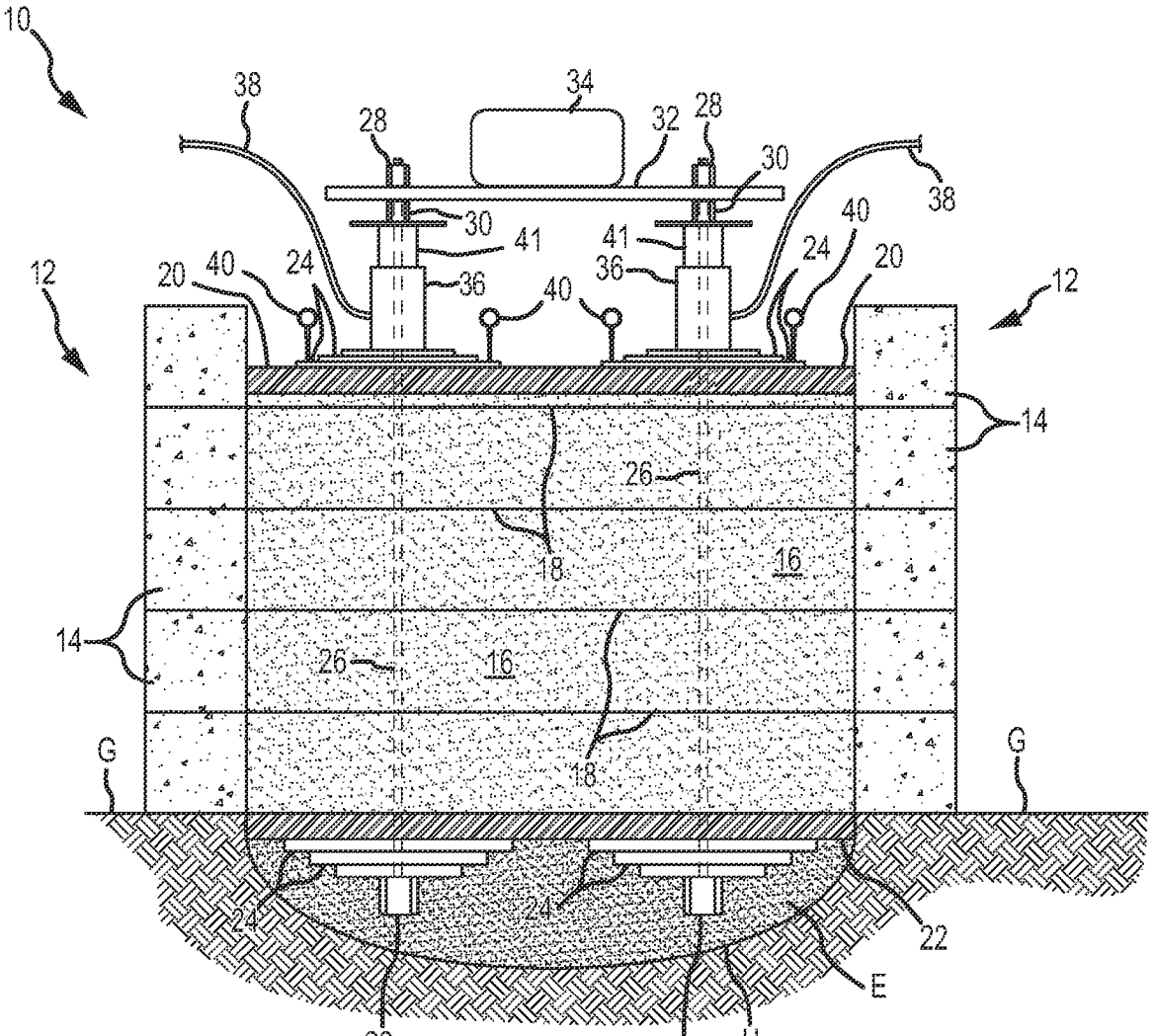
FIG. 3 is another cross-sectional view of the load frame of FIG. 1 and further showing a vibratory element for compaction purposes.

Referring also to FIG. 3, in addition to providing a static compressive force by use of the jacks 36, vibratory energy can be introduced for compaction of the fill 16 by a mechanical vibrator 34 to better simulate actual compaction efforts at the jobsite. As shown in FIG. 3, a vibratory plate 32 is mounted over the upper ends of the retention bars 26, and a mechanical vibrator 34 is mounted on the vibratory plate 32. The vibratory plate 32 extends between adjacent jacks 36 for convenient mounting of the mechanical vibrator 34. The vibratory plate 32 is positioned between spacers or bushings 30 and the upper securing nuts 28. During activation of the hydraulic jacks 36, the mechanical vibrator 34 can be activated to assist in the compaction effort.

In the construction of the load frame 10, each individual lift of fill 16 can be initially and partially compacted, such as by hand tools and/or handheld equipment such as a vibratory tamper. Final compaction is then achieved by activation of the hydraulic jacks 36 in which compaction very closely replicates the actual compaction effort to be conducted at the project. Additional compaction effort can be supplemented with the mechanical vibrator 34. In some cases, it may not be necessary to provide any initial manual compaction, and all of the compaction is therefore achieved by compressive force of the jacks 36, and supplemented as needed with the mechanical vibrator 34. The device 10 therefore achieves full-scale replication of project compaction without having to construct a much larger and labor-intensive model or prototype of the geostructural construction.

Figure 4:
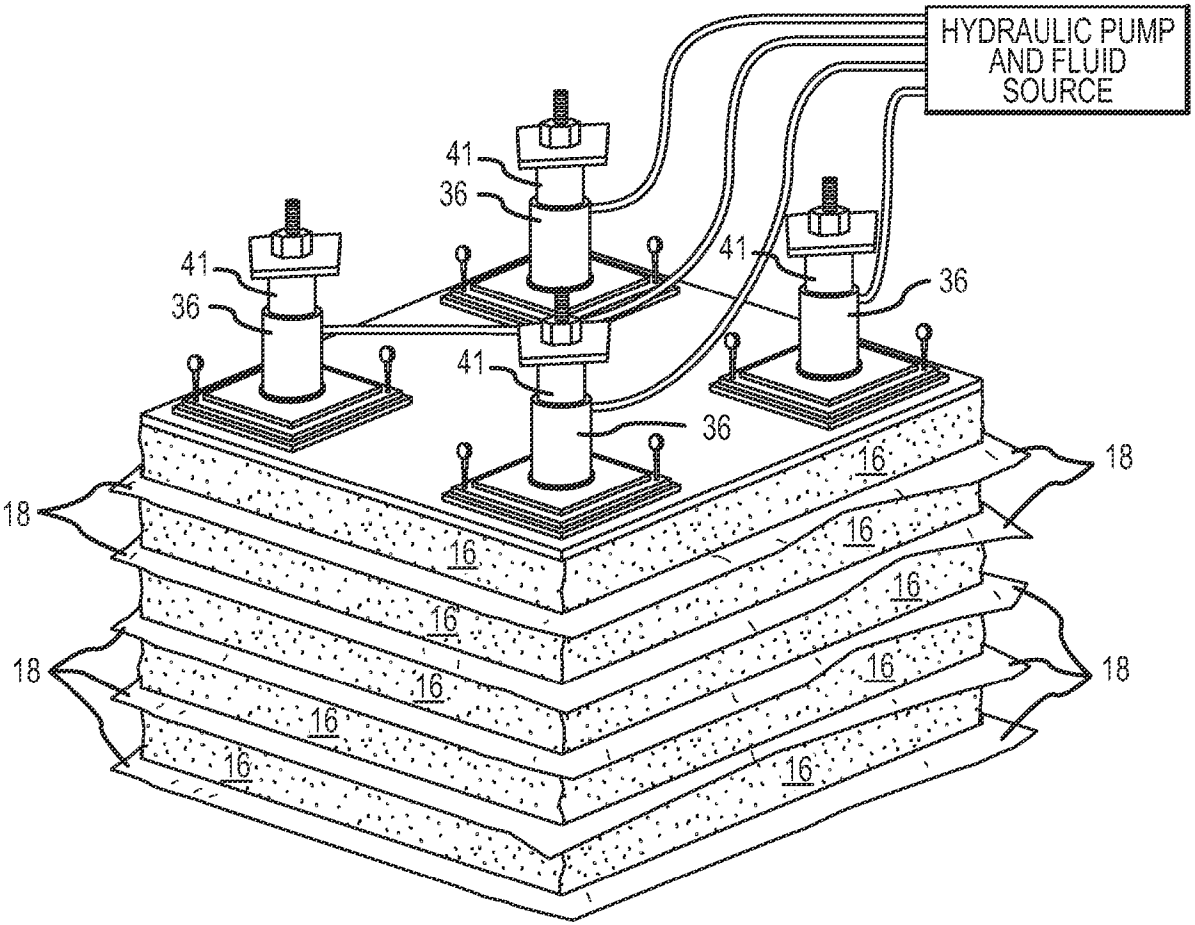
FIG. 4 illustrates the walls of the load frame of FIG. 1 removed.

Referring to FIG. 4, the blocks 14 have been removed therefore exposing the lifts of fill 16 and the geosynthetic sheets 18. A visual inspection can be made to determine performance parameters for the simulated construction, such as observing the disposition of the geosynthetic layers and uniformity of compaction of the fill 16 to achieve maximum dry density. As discussed below, it is desirable to conduct density/compaction testing when the fill 16 has an allowable range of water content in order to achieve acceptable dry density specifications.

Upon completion of compaction, desired soil density tests can be conducted to determine density characteristics and whether the selected combination of fill and geosynthetic material used within the load frame achieved project specifications. As understood by those skilled in the art, soil density testing can be conducted by a nuclear densometer, by other types of soil density gauges, or by a manual drive cylinder method in accordance with ASTM D2937-10.

After the blocks 14 have been removed, it is also possible to conduct further loading in order to stimulate both static and live loading conditions for the project. For example, after the desired compaction has been achieved, it may be desirable to provide cyclical loading over time to replicate loading conditions at the project, and to further determine whether the selected combination of fill and geosynthetic material performs as expected. The cyclical loading can be conducted by selected cycles of activation and deactivation of the hydraulic cylinders 36 and selected activation and deactivation of the mechanical vibrator 34. Cyclical test loading sequences allow an inspector to view the performance of the fill and geosynthetic material, and to look for potential problems such as non-uniform shifting or displacement of fill or deformation of the geosynthetic layers which may indicate potential sheer stress failures or other types of potential failures.

In another aspect of the invention, use of the load frame allows engineers to quickly and efficiently experiment with different types of soil, aggregate, and geosynthetic materials that may optimize construction of each project. For example, there may be a need to provide a layer of coarser aggregate for drainage purposes along a particular section of the sub grade of a project, but with a goal of also avoiding unacceptable compaction at that area. The load frame of the present invention is ideal for testing various combinations of fill and geosynthetic materials, and in this example, compaction can be quickly evaluated for the area employing the coarser aggregate. In the event introduction of the coarser aggregate did not meet specifications, another test could be performed by assembling another test sample of fill and geosynthetics in the load frame.

Figure 5:
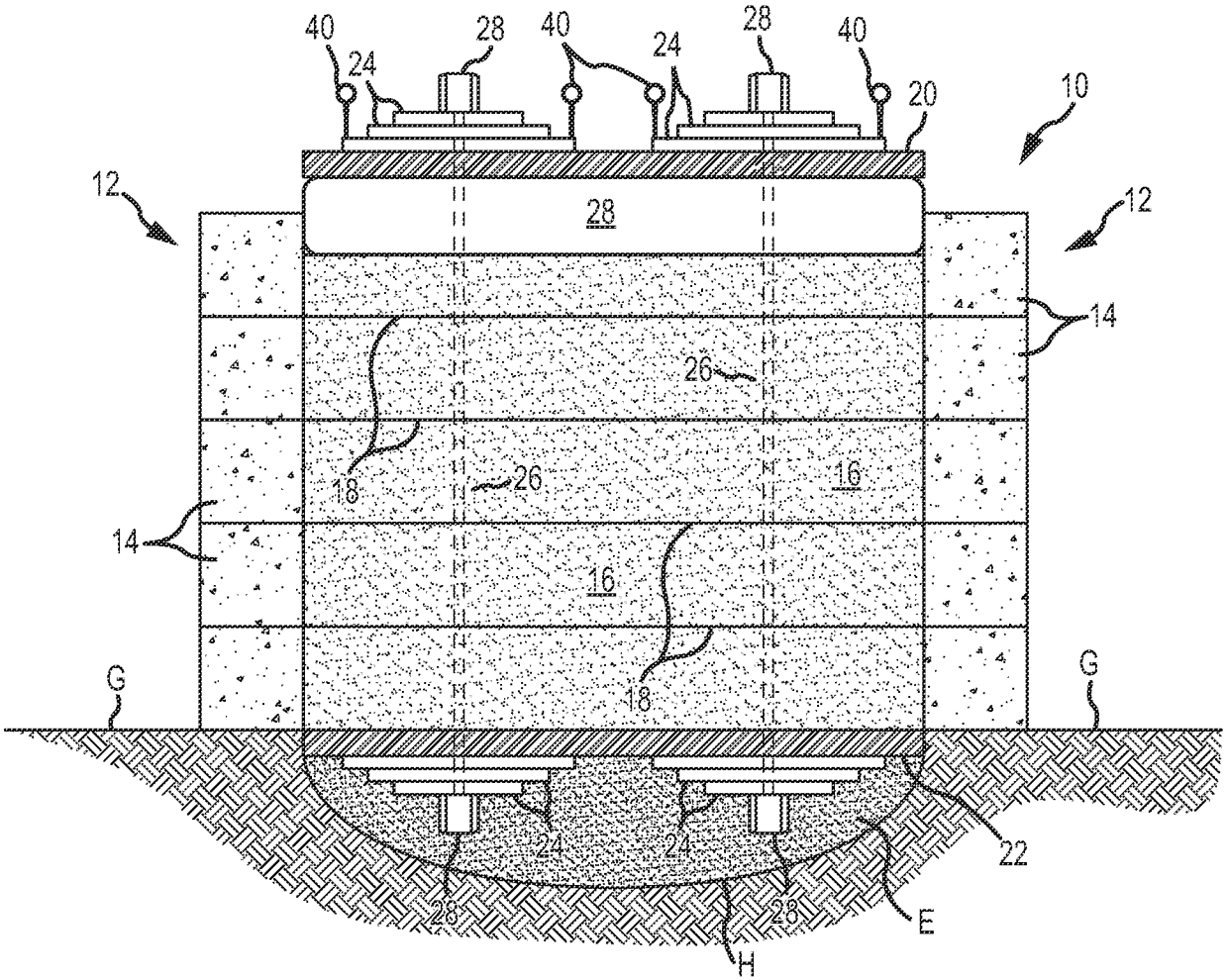
FIG. 5 illustrates a cross-sectional view of another method for compacting fill within the load frame, namely, use of an inflatable member.

Referring to FIG. 5 in another embodiment of the load frame 10, in lieu of the hydraulic jacks 36, compression is provided by an inflatable airbag 28. The airbag 28 is placed below the upper load plate 20 in order to provide a compressive force for compaction. The airbag 28 is selectively inflated by a source of compressed air (not shown). The airbag 28 can also be inflated and deflated to simulate various static and live loading conditions. Therefore, the airbag 28 can serve to simulate both compaction and loading conditions. In this way, the fill and geosynthetic material may be evaluated to confirm project specifications. Further compressive forces and cyclical loading can be conducted by removing the blocks 14, in the same manner as discussed with respect to FIG. 4.

Figure 6:
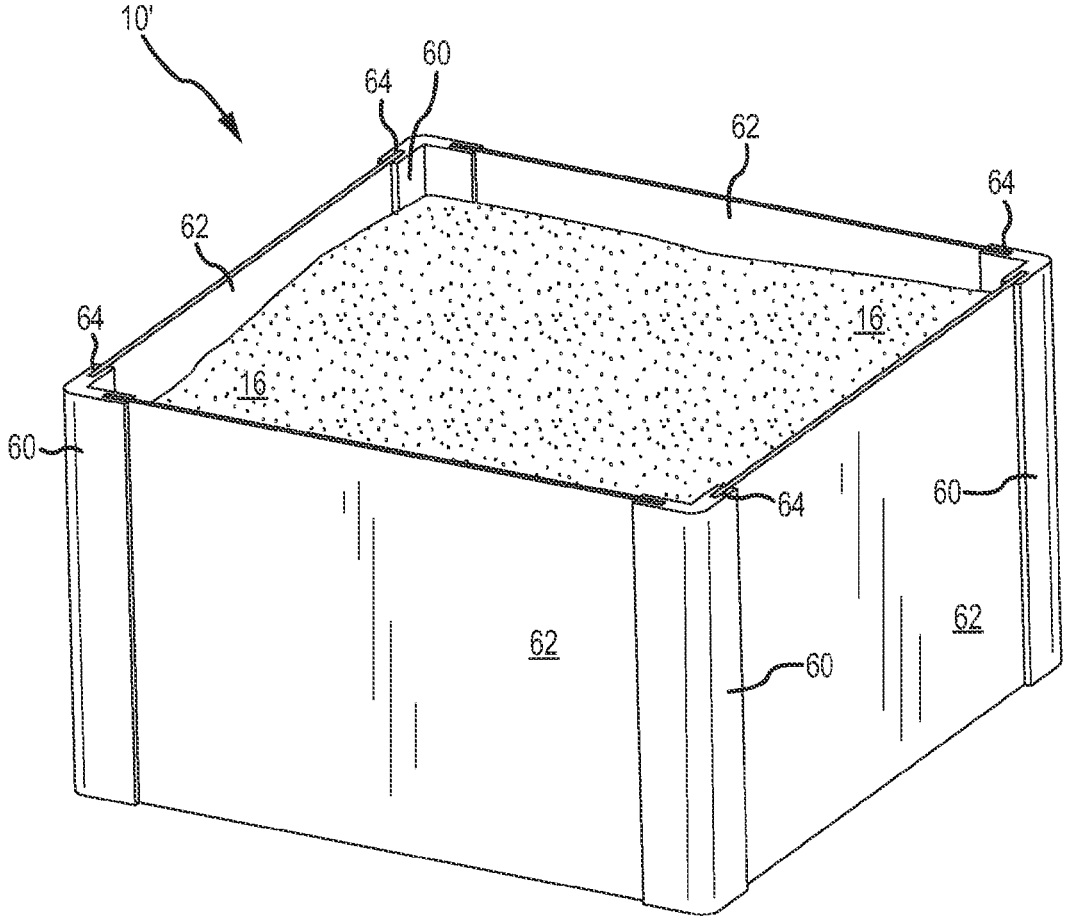
FIG. 6 is a perspective view of another embodiment of a load frame incorporating removable panels.

Referring to FIG. 6, yet another embodiment for the load frame 10' is illustrated in which the load frame is constructed from a plurality of panels and interconnecting brackets. More specifically, the load frame 10' includes brackets 60 located at each corner of the load frame, and panels 62 extending between the brackets 60. The ends of the panels 62 may be inserted within corresponding grooves or channels 64 formed in the brackets 60. For the load frame 10' of FIG. 6, the geosynthetic layers or sheets 18 must therefore be cut to fit within the enclosed area within the load frame. Compaction force can be provided for the load frame 10' utilizing either the hydraulic jacks 36 or the inflatable airbag 28, and supplemented as necessary with vibratory energy supplied by the vibrator 34.

In yet another aspect of the invention, it is also contemplated that compaction force can be provided in combination by a plurality of hydraulic jacks 36 and by an inflatable airbag 28. In this combination, it is contemplated that the jacks 36 could be used to provide the primary compaction force and the airbag 28 could be used to supplement required compressive force, as well as to provide simulation of cyclical live loading conditions. Inflation and deflation of the airbag can be achieved relatively quickly which makes it ideal for simulating some live loading conditions. The mechanical vibrator 34 can also be used to further supplement required compaction.

Figure 7:
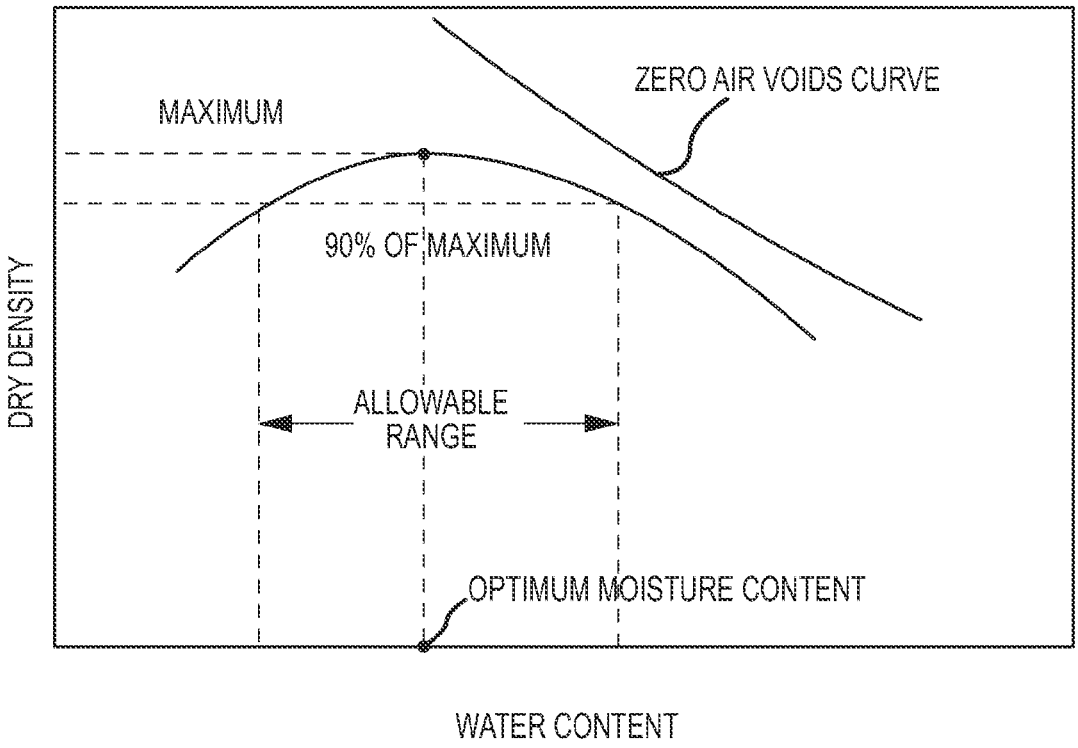
FIG. 7 is an example graph showing optimal moisture content for achieving maximum dry density of soil with respect to compaction according to the system and method of the invention.

Referring to FIG. 7, a sample graph is illustrated showing the relationship between the density of soil and water content, known as a Proctor curve. The example of FIG. 7 shows a 90% compaction curve. As understood by those skilled in the art, it is desirable to construct earthen supported structures in which soil is compacted at or within an allowable range of its maximum dry density. Fill material to be used in the testing system and method of the invention is preferably analyzed to determine moisture content, and then a Proctor curve can be created like FIG. 7 to determine a value for the optimum moisture content of the sample, and thus the maximum unit weight or density. The fill material 16 used in the system and testing method of the invention is analyzed prior to compaction in the load frame 10, and a corresponding Proctor curve is created that provides a value for the optimum moisture content of the fill sample. The Proctor curve provides an indication of the greatest amount of compaction that can be achieved based upon moisture content of the sample. Often times, back fill material is too wet or too dry, and therefore compaction cannot meet certain standards. The 95% maximum dry density standard is one industry acceptable standard for controlling out of range moisture contents.

As also shown in FIGS. 1-5, dial indicators 40 are provided to measure deflection of the upper load plate 20. The dial indicators provide an indication of the distance that the upper load plate 20 moves in response to pressure applied from the hydraulic jacks 36. A pressure gauge (not shown) at the hydraulic pump 50 provides a loading value in pounds per square inch (PSI). The deflections can be recorded along with the loading value(s). The loading values in PSI can be converted to loads in pounds applied to the upper load plate. Compaction testing is conducted to determine fill density for the fill 16 in the load frame, and assuming desired compaction has been achieved, a relationship can then be established between compaction and deflection and/or loading values. For example, a curve could be plotted that relates the load supplied from the hydraulic jacks and/or the deflection measured at the dial indicators to the compaction achieved for the sample of fill within the load frame. Baseline data can be developed to determine the amount of deflection required to properly compact a fill sample within the load frame, along with the required load to be applied for achieving the deflection. In this way, the testing method of the present invention can be repeated for each project and optimum compaction can be more quickly determined with the pre-established baseline data that provides the amount of loading required and the expected measured deflections to achieve desired compaction.

In the construction of the load frame with the desired number of layers or lifts of fill material and layers of geosynthetic material, one method is to construct each separate layer or lift of fill material and corresponding layer(s) of geosynthetic material, and to then apply the loading apparatus for each lift to compact the lift. Another method is to construct multiple lifts and corresponding layer(s) of geosynthetic material, and then apply the loading apparatus. Depending upon the type of soil and aggregate and the depths of the lifts of fill material, sequential construction or multiple lift construction can be adopted to best replicate field practices to be used at the jobsite, and to best test and validate design parameters.

Although the load frame of the invention is described for use with evaluating geosynthetically confined soils, the load frame is also useful for conducting compaction evaluation and testing for granular fill material by itself. Therefore, for those projects in which it is only necessary to evaluate fill material, the load frame provides a solution for quickly and efficiently evaluating soil and aggregate characteristics to test and confirm design specification parameters.

The invention has been described with respect to various preferred embodiments. However, it shall be understood that modifications can be made to the invention within the scope of the claims appended hereto.

What is claimed is:

1. A device for testing design specifications for a construction project incorporating geosynthetically confined soils, comprising:

a load frame having a plurality of walls connected to one another forming an enclosure;

a plurality of layers of geosynthetic material placed within an open space between said plurality of walls and within the enclosure;

a plurality of layers of fill material located between said plurality of layers of geosynthetic material within the enclosure;

an upper load plate covering the open space;

at least one force applying member communicating with said upper load plate for applying a force to compact the fill material; and wherein force is applied by said force applying member to compact the fill material.

2. A device, as claimed in claim 1, wherein:

said at least one force applying member includes a plurality of hydraulic jacks spaced from one another over said upper load plate.

3. A device, as claimed in claim 1, wherein:

said at least one force applying member includes an airbag positioned in contact with said upper load plate.

4. A device, as claimed in claim 1, further including:

a lower load plate placed beneath a most lower layer of said plurality of layers of fill material;

at least one retention member interconnecting said upper load plate and said lower load plate; and wherein when force is applied by said force applying member, said upper and lower load plates secure said fill material and layers of geosynthetic materials enabling the force to compact the fill material.

5. A device, as claimed in claim 4, wherein an upper end of said retention member is a retention bar that extends through said upper load plate and through said force applying member.

6. A device, as claimed in claim 5, further including:

a nut threaded over an upper end of said retention bar to secure said retention bar to said force applying member.

7. A device, as claimed in claim 4, wherein:

said retention member is a retention bar that interconnects said upper and lower load plates by extending substantially vertically through said load frame including through said upper load plate, an upper end of said retention bar further extending through said force applying member, and a lower end of said retention bar extending below said lower load plate.

8. A device, as claimed in claim 7, further including:

an upper nut threaded over an upper end of said retention bar to secure said retention bar to said force applying member; and a lower nut threaded over a lower end of said retention bar to secure said retention bar to said lower load plate.

9. A device, as claimed in claim 4, wherein:
said at least one retention member includes a plurality of retention members spaced from one another within said load frame.

10. A device, as claimed in claim 1, wherein:
said at least one force applying member includes a plurality of hydraulic jacks spaced from one another over said upper load plate and an airbag positioned in contact with said upper load plate.

11. A device, as claimed in claim 1, wherein:
said at least one force applying member includes a mechanical vibrator for supplying vibratory energy to compact said fill material.

12. A device, as claimed in claim 1, wherein:
said at least one force applying member supplies static energy, vibratory energy, or combinations thereof in order to replicate compaction efforts at a job site.

13. A device, as claimed in claim 1, further including:
at least one force distributing plate placed beneath said force applying member for distributing force to said upper load plate.

14. A device, as claimed in claim 1, wherein:
said walls are constructed from blocks or bricks.

15. A device, as claimed in claim 1, wherein:
said walls are constructed from panels with brackets for securing the panels to one another.

16. A device, as claimed in claim 1, further including:
an indicator mounted to said upper load plate to measure the deflection of said load plate as force is applied to compact the fill material.

17. A device, as claimed in claim 2, further including:
a hydraulic pump for supplying pressurized hydraulic fluid to said plurality of hydraulic jacks, and a pressure indicator communicating with said hydraulic pump to record an amount of pressure supplied to said hydraulic jacks.

18. A method to test design specifications for constructions incorporating geosynthetically confined soils, comprising:
constructing a load frame having a plurality of walls connected to one another to form an enclosure for a quantity of fill material and geosynthetic material placed within the enclosure;
installing at least one layer of geosynthetic material within an open space between said plurality of walls within the enclosure;
loading at least one layer of fill material within the open space between said plurality of walls and in contact with said layer of geosynthetic material within the enclosure;
covering the layer of geosynthetic material and layer of fill material within the enclosure;
applying force to compact said layer of fill material; and
conducting a compaction test to determine whether the layer of fill material is compacted to design specifications for the project.

19. A method, as claimed in claim 18, wherein:
said covering step includes placement of an upper load plate over said geosynthetic material and said fill material, and force is applied to said upper load plate to compact said layer of fill material.

20. A method, as claimed in claim 18, wherein:
said method includes an incremental process of constructing one layer of geosynthetic material and one layer of fill material within the open space within the enclosure, and compacting said layer of fill material, said incremental processes being repeated a plurality of times to construct a plurality of layers of geosynthetic material and corresponding plurality of layers of fill material.

21. A method, as claimed in claim 18, further including:
creating a Proctor compaction curve to establish a desired dry density relationship between moisture content and desired dry density for said fill material;
testing the fill material prior to loading in said load frame to determine fill material conditions including moisture content; and
adjusting moisture content as necessary to enable compaction occurring during said force applying step to achieve design specifications for said project including allowable dry density ranges for said fill material.

22. A method, as claimed in claim 18, further including:
providing an indicator mounted to said upper load plate to measure the deflection of said load plate as force is applied to compact the fill material;
establishing a dry density numerical relationship between a Proctor compaction curve for the fill material used and the measured deflection to determine whether the fill material has been adequately compacted by force applied; and
comparing the dry density numerical relationship recorded with the compaction test to confirm the fill material is capable of being compacted in accordance with compaction specifications of said project.

23. A method, as claimed in claim 18, wherein:
force is applied by a plurality of hydraulic jacks spaced from one another over an upper load plate covering said layer of fill material and said layer of geosynthetic material.

24. A method, as claimed in claim 18, wherein:
force is applied by an airbag.

25. A method, as claimed in claim 18, wherein:
said force applying step includes providing static energy or vibratory energy or combinations thereof to compact said layer of fill material.

26. A method, as claimed in claim 18, wherein:
said load frame further includes an upper load plate placed over the layer of geosynthetic material and layer of fill material, a lower load plate placed beneath a lower surface of said layer of fill material, at least one retention member interconnecting said upper load plate and said lower load plate; and wherein when force is applied by a force applying member, said upper and lower load plates secure said fill material and layer of geosynthetic material enabling the force to compact the fill material.

27. A method, as claimed in claim 26, wherein:
said at least one force applying member includes at least one of (i) a plurality of hydraulic jacks spaced from one another over said upper load plate, (ii) a mechanical vibrator for supplying vibratory energy to compact said fill material, (iii) an airbag positioned in contact with said upper load plate, or combinations thereof.

28. A method, as claimed in claim 26, wherein:
said at least one retention member interconnects said upper and lower load plates by extending substantially vertically through said load frame including through said upper load plate, an upper end of said retention member further extending through said force applying member, and a lower end of said retention member extending below said lower load plate.

29. A device for testing design specifications for a construction project incorporating geosynthetically confined soils, comprising:
a load frame having a plurality of walls connected to one another forming an enclosure;

a plurality of layers of geosynthetic material placed within an open space between said plurality of walls within the enclosure;

a plurality of layers of fill material located between said plurality of layers of geosynthetic material within the enclosure;

an upper load plate covering the open space;

at least one force applying member communicating with said upper load plate for applying a force to compact the fill material;

a lower load plate placed beneath a most lower layer of said plurality of layers of fill material;

at least one retention member interconnecting said upper load plate and said lower load plate; and wherein force is applied by said force applying member to compact the fill material, and said upper and lower load plates secure said layers of fill material and geosynthetic materials enabling the force applied to compact the fill material within the enclosure.

30. A device, as claimed in claim 29, wherein:

said at least one force applying member includes at least one of (i) a plurality of hydraulic jacks spaced from one another over said upper load plate, (ii) a mechanical vibrator for supplying vibratory energy to compact said fill material, (iii) an airbag positioned in contact with said upper load plate, or combinations thereof.

* * * * *